US007609232B2

(12) United States Patent
Sakata

(10) Patent No.: US 7,609,232 B2
(45) **Date of Patent: *Oct. 27, 2009**

(54) PLASMA DISPLAY DEVICE

(75) Inventor: Kazuaki Sakata, Yamanashi-ken (JP)

(73) Assignee: Panasonic Corporation, Osaka (JP)

( * ) Notice: Subject to any disclaimer, the term of this patent is extended or adjusted under 35 U.S.C. 154(b) by 665 days.

This patent is subject to a terminal disclaimer.

(21) Appl. No.: 11/280,271

(22) Filed: Nov. 17, 2005

(65) Prior Publication Data

US 2006/0109210 A1 May 25, 2006

(30) Foreign Application Priority Data

Nov. 24, 2004 (JP) ..... 2004-338724

(51) Int. Cl.
*G09G 3/28* (2006.01)
*G09G 3/10* (2006.01)

(52) U.S. Cl. ..... 345/60; 315/169.4

(58) Field of Classification Search ..... 345/60; 315/169.4

See application file for complete search history.

(56) References Cited

U.S. PATENT DOCUMENTS 6,466,186 B1 * 10/2002 Shimizu et al. ..... 345/60
6,486,611 B2 * 11/2002 Tokunaga et al. ..... 315/169.4
6,833,824 B2 * 12/2004 Ide et al. ..... 345/66
2001/0026254 A1 * 10/2001 Ide et al. ..... 345/60
2002/0054002 A1 5/2002 Tokunaga et al.
2004/0075388 A1 * 4/2004 Miyashita et al. ..... 313/586
2004/0113870 A1 * 6/2004 Roh et al. ..... 345/60
2005/0264487 A1 * 12/2005 Tokunaga et al. ..... 345/63
2006/0267878 A1 * 11/2006 Ikeda et al. ..... 345/68

FOREIGN PATENT DOCUMENTS

EP 1 152 387 A1 11/2001
JP 07-192630 A 7/1995
WO 2004/055771 A1 7/2004

OTHER PUBLICATIONS

Saksena et al. Cathodo-Luminescence of MgO, Jun. 8, 1954, National Physical Laboratory of India, New Delhi, India, pp. 814-815.*

* cited by examiner

*Primary Examiner*—Amr Awad
*Assistant Examiner*—Jonathan Boyd
(74) *Attorney, Agent, or Firm*—Sughrue Mion, PLLC

(57) ABSTRACT

A plasma display device in which in a sustain period for each subfield, a time point to clamp to a second potential a sustain pulse belonging to a first group including a sustain pulse to be first applied is delayed comparing to a time point to clamp to the second potential a sustain pulse belonging to other groups.

6 Claims, 13 Drawing Sheets

CROSS - SECTION ALONG V3 - V3

CROSS - SECTION ALONG W2 - W2

FIG. 9

| | LIGHT EMISSION PATERN | | | | | | | | | | | |
|---|---|---|---|---|---|---|---|---|---|---|---|---|
| GRAY SCALE | SF1 | SF2 | SF3 | SF4 | SF5 | SF6 | SF7 | SF8 | SF9 | SF10 | SF11 | SF12 |
| 1ST | ● | | | | | | | | | | | |
| 2ND | ○ | ● | | | | | | | | | | |
| 3RD | ○ | ○ | ● | | | | | | | | | |
| 4TH | ○ | ○ | ○ | ● | | | | | | | | |
| 5TH | ○ | ○ | ○ | ○ | ● | | | | | | | |
| 6TH | ○ | ○ | ○ | ○ | ○ | ● | | | | | | |
| 7TH | ○ | ○ | ○ | ○ | ○ | ○ | ● | | | | | |
| 8TH | ○ | ○ | ○ | ○ | ○ | ○ | ○ | ● | | | | |
| 9TH | ○ | ○ | ○ | ○ | ○ | ○ | ○ | ○ | ● | | | |
| 10TH | ○ | ○ | ○ | ○ | ○ | ○ | ○ | ○ | ○ | ● | | |
| 11TH | ○ | ○ | ○ | ○ | ○ | ○ | ○ | ○ | ○ | ○ | ● | |
| 12TH | ○ | ○ | ○ | ○ | ○ | ○ | ○ | ○ | ○ | ○ | ○ | ● |
| 13YH | ○ | ○ | ○ | ○ | ○ | ○ | ○ | ○ | ○ | ○ | ○ | ○ |

○: SF EMITTING LIGHT

●: SF STOPPING LIGHT EMISSION BY SELECTIVE ERASURE ADDRESS DISCHARGE

PLASMA DISPLAY DEVICE

BACKGROUND OF THE INVENTION

1. Field of the Invention

The present invention relates to a plasma display device using a plasma display panel.

2. Description of the Related Background Art

Currently, as a thin display device, an AC type (alternating discharge type) plasma display panel becomes commercially available. In the plasma display panel, two substrates, that is, a front glass substrate and a rear glass substrate are disposed with a predetermined space as faced to each other. On the inner surface (the surface facing the rear glass substrate) of the front glass substrate as a display surface, multiple row electrode pairs are formed as sustain electrode pairs, which are paired with each other and extended in parallel. On the rear glass substrate, multiple column electrodes are extended and formed as address electrodes as intersecting with the row electrode pairs, and are coated with a fluorescent material. When seen from the display surface side, a display cell corresponding to a pixel is formed at the intersection part of the row electrode pair with the column electrode. To the plasma display panel, gray scale addressing using a subfield method is implemented in order to obtain halftone display brightness as corresponding to input video signals.

In gray scale addressing based on the subfield method, a plurality of subfields are provided. In each of the subfields to which the number of times (or periods) to do light emission is assigned, display addressing is implemented to one field of video signals. Further, in each of the subfields, an address stage and a sustain stage are in turn implemented. In the address stage, in accordance with input video signals, selective discharge is selectively generated between the row electrode and the column electrode in each of the display cells to form a predetermined amount of wall electric charge (or remove it). In the sustain stage, only a display cell where a predetermined amount of wall electric charge is formed is repeatedly discharged, and a light emission state in association with that discharge is maintained. Furthermore, at least at the starting subfield, prior to the address stage, an initializing stage is implemented. In the initializing stage, in all the display cells, reset discharge is generated between the paired row electrodes to implement the initializing stage which initializes the amount of wall electric charge remaining in all the display cells.

In the sustain stage, in the case where many display cells are set in the lighting state and a sustain pulse is applied to generate discharge in many cells almost at the same time, a large amount of current is carried momentarily, and distortion occurs in the voltage waveform of the sustain pulse. Consequently, in accordance with a slight shift in a time point to start discharge, the voltage value being applied in discharge is varied in each of the display cells, variation occurs in discharge intensity, and thus display quality might be deteriorated.

SUMMARY OF THE INVENTION

It is an object of the present invention is to provide a plasma display device which can prevent variation in discharge intensity in each display cell to improve display quality.

A plasma display device according to the invention is a device for displaying an image on a plasma display panel in accordance with an input video signal, the plasma display panel having a plurality of row electrode pairs, a plurality of column electrodes intersecting with the plurality of row electrode pairs and forming display cells at the intersections, respectively, and a display period for one field of the input video signal is configured of a plurality of subfields each formed of an address period and a sustain period for the image display, the plasma display device comprising: an address portion which selectively generates address discharge in each of the display cells in accordance with pixel data based on the video signal in the address period; a sustain portion which applies a sustain pulse between row electrodes forming each of the row electrode pairs in the sustain period; and a reset portion which applies a reset pulse between the row electrodes forming the row electrode pair before the address period for at least one subfield in one field of a display period in order to generate reset discharge in all of the display cells, wherein the sustain portion includes: a first transition portion which makes resonance transition of a potential of a row electrode of each of the row electrode pairs from a first potential to a second potential; a clamp portion which clamps the potential of the row electrode to the second potential; and a second transition portion which makes resonance transition of the potential of the row electrode from the second potential to the first potential, and wherein a first step of making transition from the first potential to the second potential, a second step of clamping to the second potential, and a third step of making transition from the second potential to the first potential are sequentially implemented in order to generate the sustain pulse, and in the sustain period for each of the subfields, a time point to clamp to the second potential at least one sustain pulse belonging to a first group including a sustain pulse to be first applied is delayed comparing to a time point to clamp to the second potential a sustain pulse belonging to other groups.

BRIEF DESCRIPTION OF THE DRAWINGS

FIG. 9 is a diagram illustrating light emission patterns of the plasma display device;

DETAILED DESCRIPTION OF THE INVENTION

Hereinafter, an embodiment according to the present invention will be described in detail with reference to the drawings.

Figure 1:
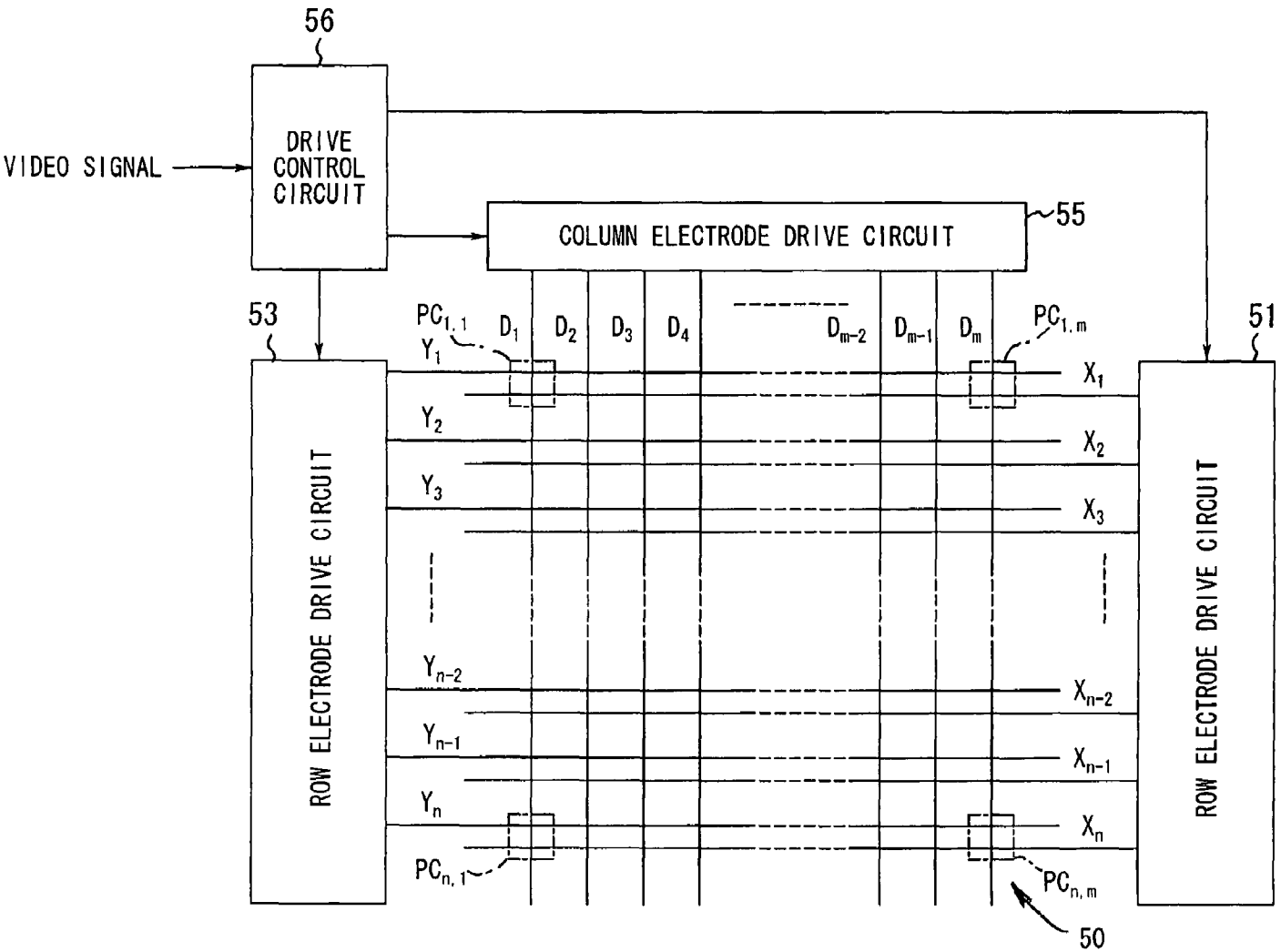
FIG. 1 is a diagram illustrating an outline configuration of a plasma display device according to the invention.

FIG. 1 is a diagram illustrating an outline configuration of a plasma display device according to the invention.

As shown in FIG. 1, the plasma display device is configured of a PDP 50 as a plasma display panel, an X-row electrode drive circuit 51, a Y-row electrode drive circuit 53, a column electrode drive circuit 55, and a drive control circuit 56.

In the PDP 50, column electrodes $D_1$ to $D_m$ are extended and arranged in the longitudinal direction (vertical direction) of a two-dimensional display screen, and row electrodes $X_1$ to $X_n$ and row electrodes $Y_1$ to $Y_n$ are extended and arranged in the lateral direction (the horizontal direction) thereof. The row electrodes $X_1$ to $X_n$ and row electrodes $Y_1$ to $Y_n$ forms row electrodes pairs $(Y_1, X_1)$, $(Y_2, X_2)$, $(Y_3, X_3)$, Ψ, $(Y_n, X_n)$ which are paired with those adjacent to each other serve as the first display line to the nth display line in the PDP 50. In each intersection part of the display lines with the column electrodes $D_1$ to $D_m$ (areas surrounded by dashed lies in FIG. 1), a display cell PC which serves as a pixel is formed. More specifically, in the PDP 50, the display cells $PC_{1,1}$ to $PC_{1,m}$ belonging to the first display line, the display cells $PC_{2,1}$ to $PC_{2,m}$ belonging to the second display line, and the display cells $PC_{n,1}$ to $PC_{n,m}$ belonging to the nth display line are each arranged in a matrix.

Each of the column electrodes $D_1$ to $D_m$ of the PDP 50 is connected to the column electrode drive circuit 55, each of the row electrodes $X_1$ to $X_n$ is connected to the X-row electrode drive circuit 51, and each of the row electrodes $Y_1$ to $Y_n$ is connected to the Y-row electrode drive circuit 53.

Figure 2:
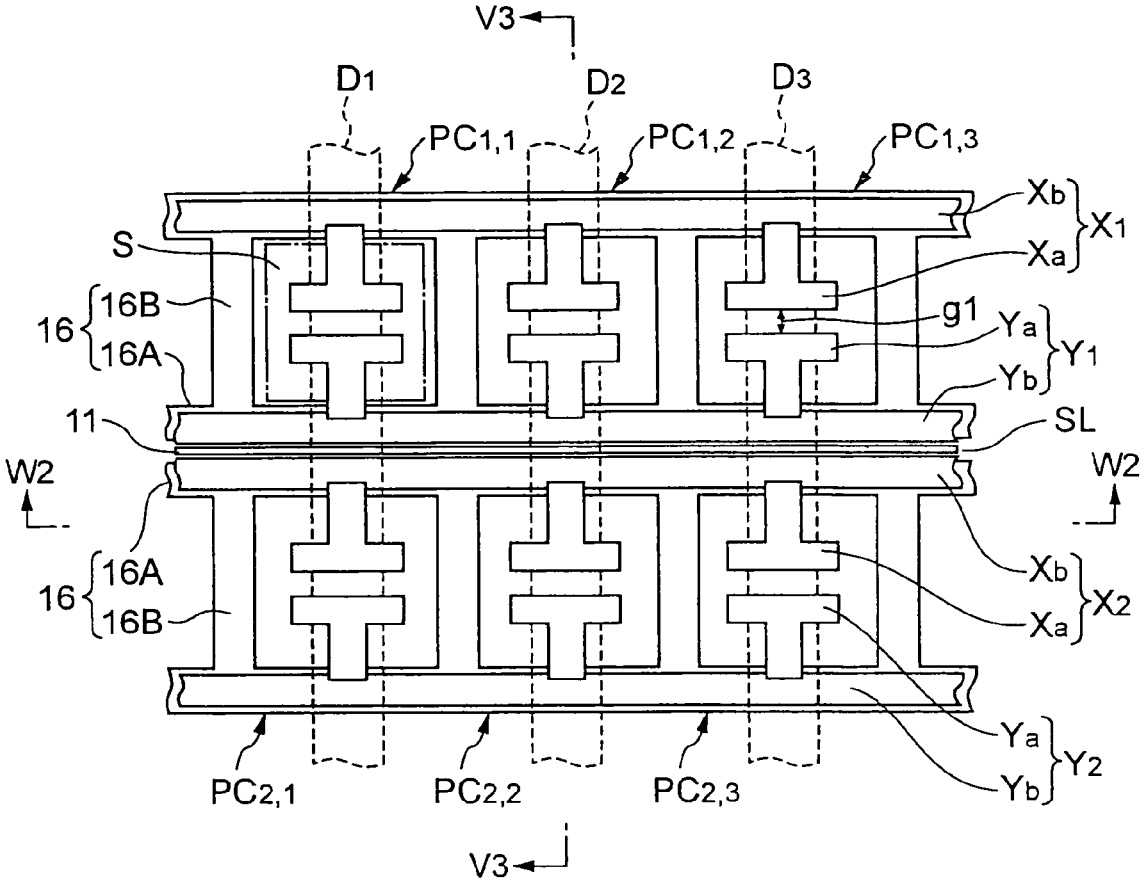
FIG. 2 is a front view schematically illustrating the internal configuration of PDP seen from the display surface side of the device shown in FIG. 1.
Figure 3:
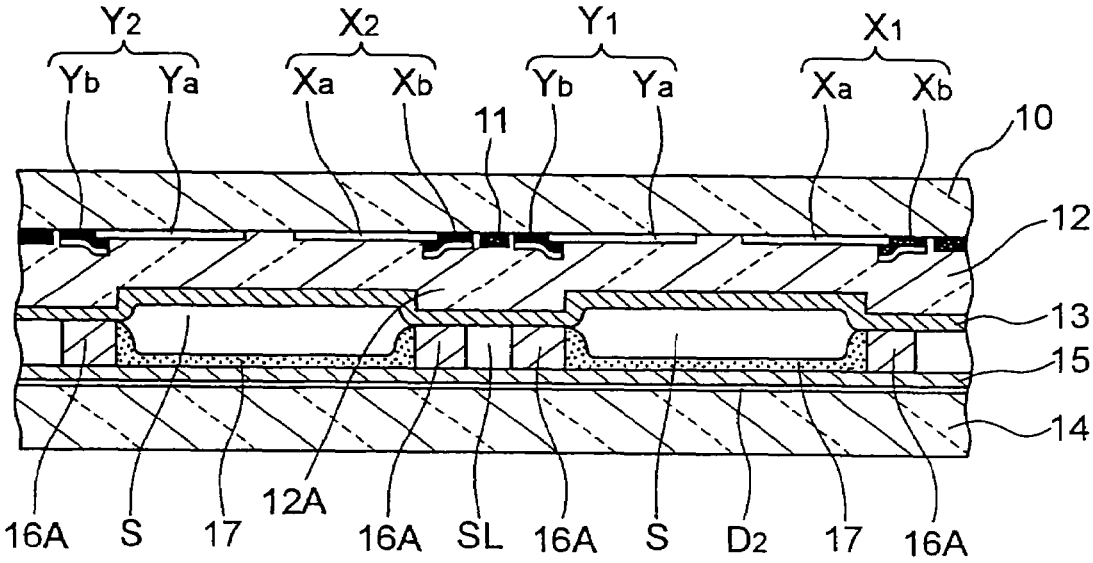
FIG. 3 is a diagram illustrating a cross section on line V3-V3 shown in FIG. 2.
Figure 4:
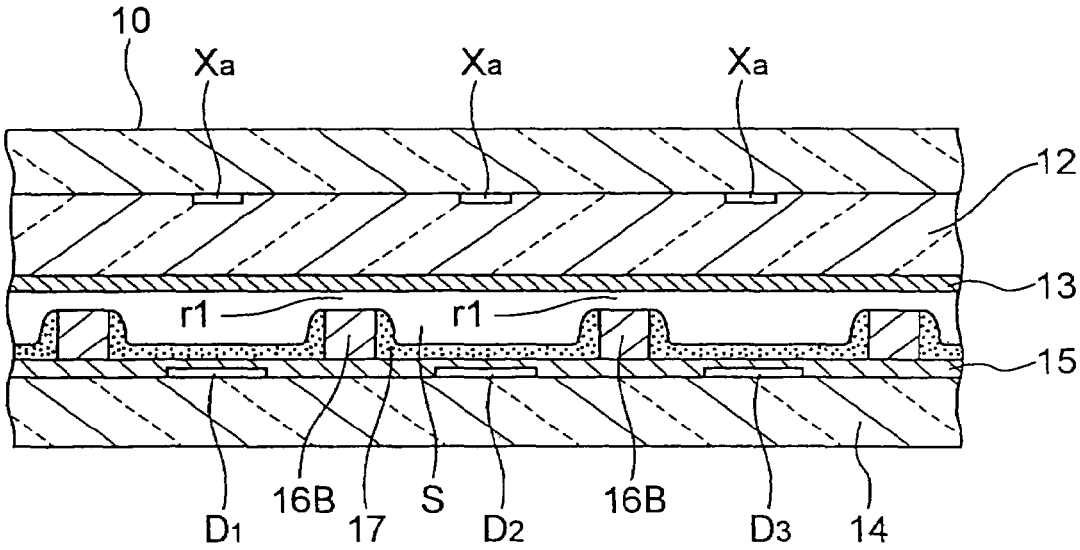
FIG. 4 is a diagram illustrating a cross section on line W2-W2 shown in FIG. 2.

FIG. 2 is a front view schematically illustrating the internal configuration of the PDF 50 seen from the display surface side. FIG. 2 depicts each of the intersection parts of each of the column electrodes $D_1$ to $D_3$ with the first display line $(Y_1, X_1)$ and the second display line $(Y_2, X_2)$ in the PDP 50. FIG. 3 depicts a diagram illustrating a cross section of the PDP 50 at a line V3-V3 in FIG. 2, and FIG. 4 depicts a diagram illustrating a cross section of the PDP 50 at a line W2-W2 in FIG. 2.

As shown in FIG. 2, each of the row electrodes X is configured of a bus electrode Xb extended in the horizontal direction in the two-dimensional display screen and a T-shaped transparent electrode Xa formed as contacted with the position corresponding to each of the display cells PC on the bus electrode Xb. Each of the row electrodes Y is configured of a bus electrode Yb extended in the horizontal direction of the two-dimensional display screen and a T-shaped transparent electrode Ya formed as contacted with the position corresponding to each of the display cells PC on the bus electrode Yb. The transparent electrodes Xa and Ya are formed of a transparent conductive film such as ITO, and the bus electrodes Xb and Yb are formed of a metal film, for example. As shown in FIG. 3, for the row electrode X formed of the transparent electrode Xa and the bus electrode Xb, and for the row electrode Y formed of the transparent electrode Ya and the bus electrode Yb, the front sides thereof are formed on the rear side of a front transparent substrate 10 to be the display surface of the PDP 50. The transparent electrodes Xa and Ya in each row electrode pair (X, Y) are extended to the counterpart row electrode side to be paired, and the flat tops of the broad parts are faced to each other through a predetermined width of discharge gap g1. Moreover, on the rear side of the front transparent substrate 10, a black or dark light absorbing layer (shade layer) 11 extended in the horizontal direction of the two-dimensional display screen is formed between a pair of the row electrode pair $(X_1, Y_1)$ and the row electrode pair $(X_2, Y_2)$ adjacent to this row electrode pair. Furthermore, on the rear side of the front transparent substrate 10, a dielectric layer 12 is formed so as to cover the row electrode pair (X, Y). On the rear side of the dielectric layer 12 (the surface opposite to the surface to which the row electrode pair is contacted), an increased dielectric layer 12A is formed at the portion corresponding to the area where a light absorbing layer 11 and the bus electrodes Xb and Yb adjacent to the light absorbing layer 11 are formed as shown in FIG. 3. On the surface of the dielectric layer 12 and the increased dielectric layer 12A, a magnesium oxide layer 13 including vapor phase magnesium oxide (MgO) monocrystal powder, described later, is formed.

On the other hand, on a rear substrate 14 disposed in parallel with the front transparent substrate 10, each of the column electrodes D is formed as extended in the direction orthogonal to the row electrode pair (X, Y) at the position facing the transparent electrodes Xa and Ya in each row electrode pair (X, Y). On the rear substrate 14, a white column electrode protective layer 15 which covers the column electrode D is further formed. On the column electrode protective layer 15, partition 16 is formed. The partition 16 is formed in a ladder shape of a lateral wall 16A extended in the lateral direction of the two-dimensional display screen at the position corresponding to the bus electrodes Xb and Yb of each row electrode pair (X, Y), and of a vertical wall 16B extended in the longitudinal direction of the two-dimensional display screen at the middle between the column electrodes D adjacent to each other. In addition, the partition 16 in a ladder shape as shown in FIG. 2 are formed at every display line of the PDF 50, and a space SL exists between the partitions 16 adjacent to each other as shown in FIG. 2. Besides, the partitions 16 in a ladder shape partition the display cells PC including a discharge space S, and the transparent electrodes Xa and Ya, each of them is separated. In the discharge space S, discharge gas including xenon gas is filled. On the side surface of the lateral wall 16A, the side surface of the vertical wall 16B, and the surface of the column electrode protective layer 15 in each of the display cells PC, a fluorescent material layer 17 is formed so as to cover the entire surfaces thereof as shown in FIG. 3. The fluorescent material layer 17 is actually formed of three types of fluorescent materials: a fluorescent material for red light emission, a fluorescent material for green light emission, and a fluorescent material for blue light emission. The discharge space S and the space SL in each of the display cells PC are closed to each other by abutting the magnesium oxide layer 13 against the lateral wall 16A as shown in FIG. 3. On the other hand, as shown in FIG. 4, since the vertical wall 16B is not abutted against the magnesium oxide layer 13, a space r1 exists therebetween. More specifically, the discharge spaces S of each of the display cells PC adjacent to each other in the lateral direction of the two-dimensional display screen communicate with each other through the space r1.

Figure 5:
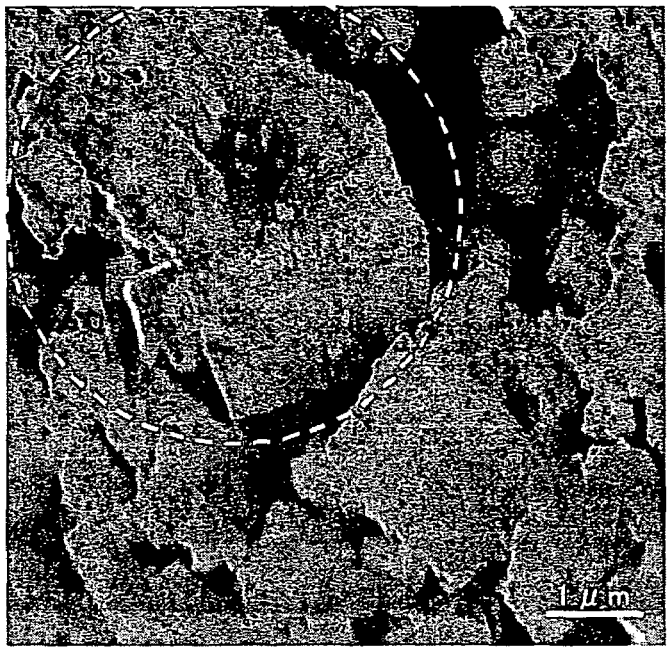
FIG. 5 is a diagram illustrating magnesium oxide monocrystals having a cubic polycrystal structure.
Figure 6:
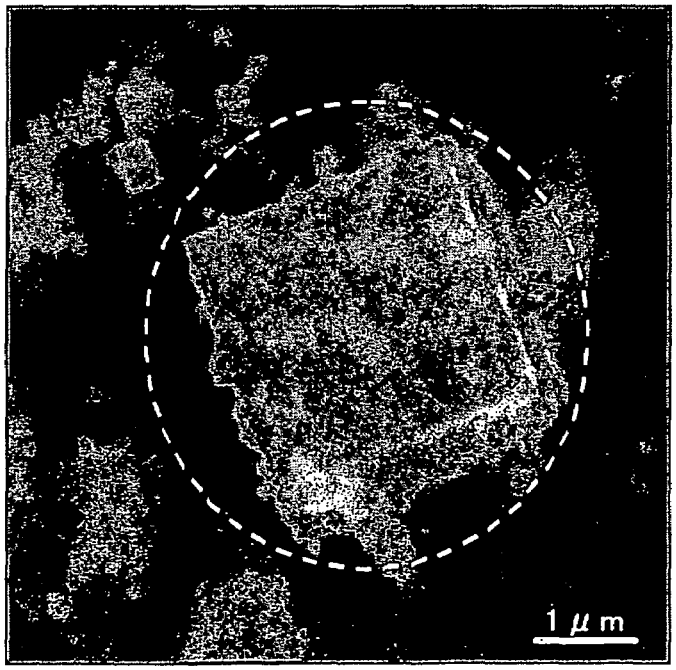
FIG. 6 is a diagram illustrating a magnesium oxide monocrystal having a cubic polycrystal structure.
Figure 7:
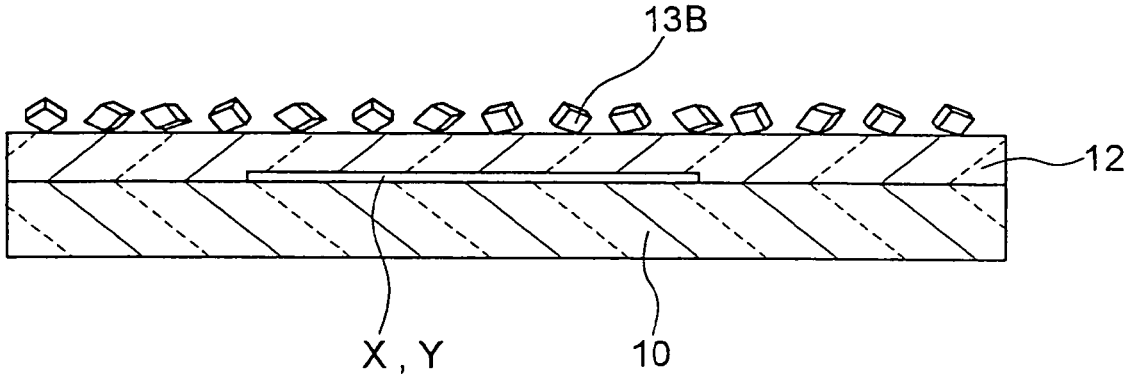
FIG. 7 is a diagram illustrating a form when magnesium oxide monocrystal powder is attached to the surface of a dielectric layer and an increased dielectric layer to form a magnesium oxide layer.

Here, magnesium oxide crystals forming the magnesium oxide layer 13 contain monocrystals obtained by vapor phase oxidation of magnesium steam that is generated by heating magnesium, such as vapor phase magnesium oxide crystals that are excited by irradiating electron beams to do CL light emission having a peak within a wavelength range of 200 to 300 nm (particularly, near 235 nm within 230 to 250 nm). The vapor phase magnesium oxide crystals contain a magnesium monocrystal having a particle diameter of 2000 angstrom or greater with a polycrystal structure in which cubic crystals are fit into each other in a SEM photo image as shown in FIG. 5, or with a cubic monocrystal structure in a SEM photo image as shown in FIG. 6. The magnesium monocrystal has features of higher purity, finer particles and less particle coagulation than magnesium oxides generated by other methods have, which contributes to improved discharge properties in discharge delay, etc. In addition, in the embodiment, the vapor phase magnesium oxide monocrystals, which are used, have an average particle diameter of 500 angstrom or greater measured by the BET method, preferably 2000 angstrom or greater. Then, as shown in FIG. 7, the magnesium oxide monocrystals are attached to the surface of the dielectric layer 12 by spraying or electrostatic coating to form the magnesium oxide layer 13. Moreover, the magnesium oxide layer 13 may be formed in which a thin magnesium oxide layer is formed on the surface of the dielectric layer 12 and the increased dielectric layer 12A by vapor deposition or sputtering and vapor phase magnesium oxide monocrystals are attached thereon.

Figure 8:
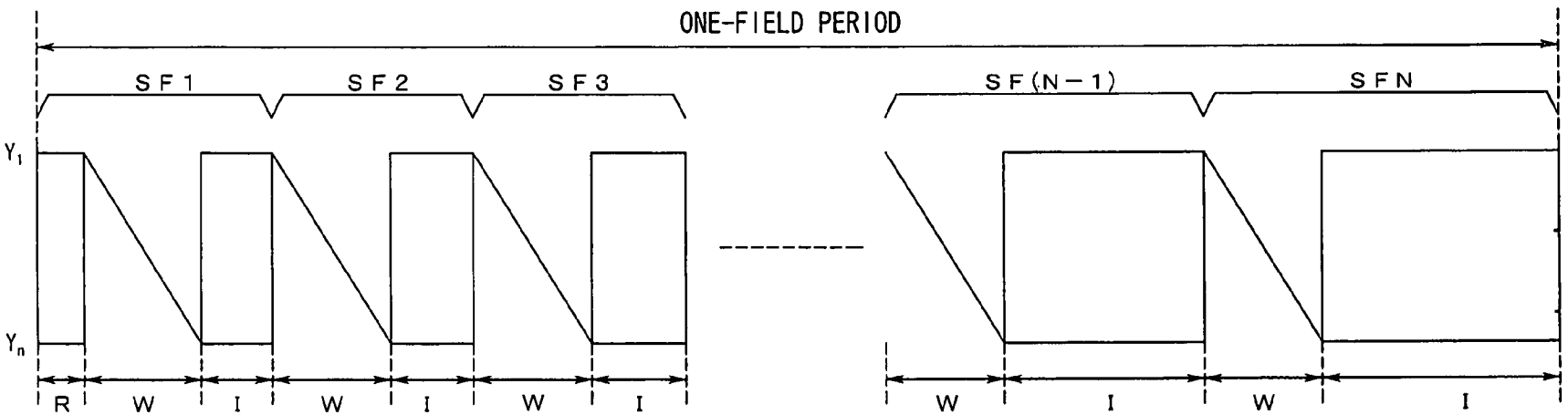
FIG. 8 is a diagram illustrating an exemplary light emission addressing sequence adopted in the plasma display device.

The drive control circuit 56 supplies various control signals that drive the PDP 50 having the structure in accordance with the light emission addressing sequence adopting a subfield method (subframe method) as shown in FIG. 8 to the X-row electrode drive circuit 51, the Y-row electrode drive circuit 53, and the column electrode drive circuit 55. The X-row electrode drive circuit 51, the Y-row electrode drive circuit 53, and the column electrode drive circuit 55 generate various drive pulses to be supplied to the PDP 50 in accordance with the light emission addressing sequence as shown in FIG. 8 and supply them to the PDP 50.

In the light emission addressing sequence shown in FIG. 8, a display period for one field (one frame) has subfields SF1 to SF12, and the address stage W and the sustain stage I are implanted in each of the subfields SF1 to SF12. Furthermore, only in the starting subfield SF1, a rest stage R is implemented prior to the address stage W. The period of the sustain stage I for the subfields SF1 to SF12 is prolonged in order of SF1 to SF12. Moreover, the period where the address stage W is implemented is an address period, and the period where the sustain stage I is implemented is a sustain period.

FIG. 9 depicts a diagram illustrating all the patterns of light emission addressing implemented based on the light emission addressing sequence as shown in FIG. 8. 13 gray scales are formed by the light emission addressing sequence of the subfields SF1 to SF12. As shown in FIG. 9, in the address stage Win one subfield in the subfields SF1 to SF12, selective erasure discharge is implemented for each of the display cells for each of the gray scales (depicted by a black circle). More specifically, wall electric charge formed in all the display cells of the PDP 50 by implementing the reset stage R remains until selective erasure discharge is implemented, and prompts discharge and light emission in the sustain stage I in each subfield SF that exists during that (depicted by a while circle). Each of the display cells becomes in a light emission state while selective erasure discharge is being done for one field period, and 13 gray scales can be obtained by the length of the light emission state.

Figure 10:
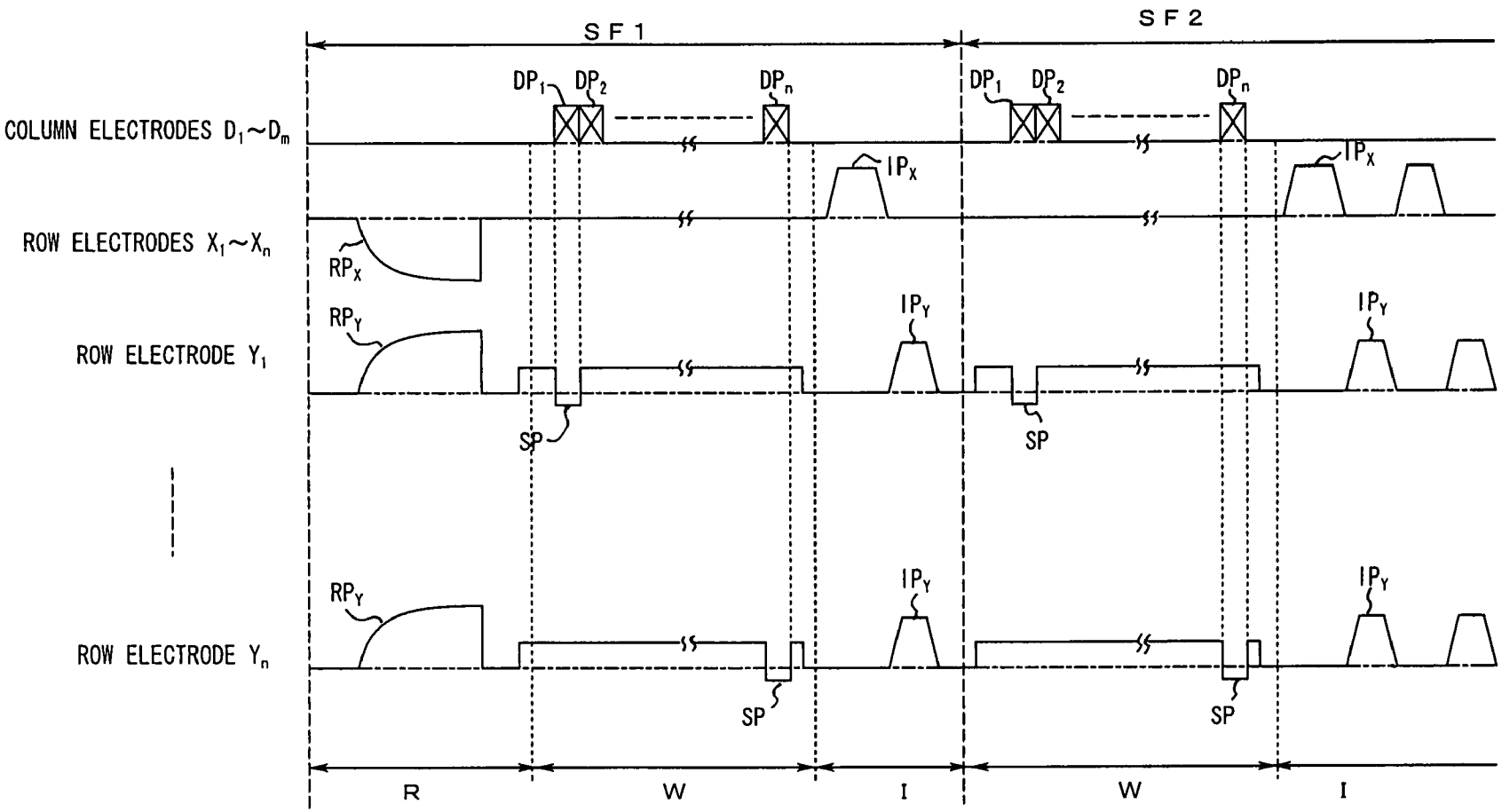
FIG. 10 is a diagram illustrating various drive pulses to be applied to PDP and application timing thereof in accordance with the light emission addressing sequence shown in FIG. 8.

FIG. 10 depicts a diagram illustrating the application timing of various drive pulses to be applied to the column electrodes D, and the row electrodes X and Y of the PDP 50, extracting SF1 and SF2 from the subfields SF1 to SF12.

In the reset stage R implemented prior to the address stage W only in the starting subfield SF1, the X-row electrode drive circuit 51 simultaneously applies a negative reset pulse $RP_X$ to the row electrodes $X_1$ to $X_n$ as shown in FIG. 10. The reset pulse $RP_X$ has a pulse waveform that the voltage value is slowly increased to reach a peak voltage Value over time. Furthermore, at the same time when the application of the reset pulse $RP_X$, the Y-row electrode drive circuit 53 simultaneously applies to the row electrodes $Y_1$ to $Y_n$ a positive reset pulse $RP_Y$ having a waveform that the voltage value is slowly increased to reach a peak voltage value over time as similar to the reset pulse $RP_X$ as shown in FIG. 10. The simultaneous application of the reset pulse $RP_X$ and there set pulse $RP_Y$, reset discharge is generated between the row electrodes X and Y in each of all the display cells $PC_{1,1}$ to $PC_{n,m}$. After the reset discharge is terminated, a predetermined amount of wall electric charge is formed on the surface of the magnesium oxide layer 13 in the discharge space S in each of the display cells PC. More specifically, it is the state that a so-called wall electric charge is formed in which positive electric charge is formed near the row electrode X and negative electric charge is formed near the row electrode Y on the surface of the magnesium oxide layer 13.

In a panel on which the vapor phase magnesium oxide layer 13 is provided as a protective layer, since discharge probability is significantly high, weak reset discharge is stably generated. By combining a bump, particularly a T-shaped electrode in a broad tip end, reset discharge is localized near a discharge gap, and thus a possibility to generate sudden reset discharge such as discharge being generated in all the row electrodes is further suppressed. Therefore, discharge is hardly generated between the column electrode and the row electrode, and stable, weak reset discharge can be generated for a short time.

Furthermore, in the configuration that the vapor phase magnesium oxide layer 13 is provided, since the discharge probability is significantly improved, the application of a single reset pulse, that is, even a one-time reset discharge allows priming effect to be continued. Thus, the reset operation and the selective erasure operation can be further stabilized. Moreover, the number of times to do reset discharge is minimized to enhance contrast.

In addition, the effect of provision of the vapor phase magnesium oxide layer 13 will be described later.

Next, in the address stage W in each of the subfields SF1 to SF12, the Y-row electrode drive circuit 53 applies positive voltages to all the row electrodes $Y_1$ to $Y_n$, and sequentially applies a scanning pulse SP having a negative voltage to each of the row electrodes $Y_1$ to $Y_n$. While this is being done, the X-electrode drive circuit 51 changes the potentials of the electrodes $X_1$ to $X_n$ to 0 V. The column electrode drive circuit 55 converts each data bit in a pixel drive data bit group DB1 corresponding to the subfield SF1 to a pixel data pulse DP having a pulse voltage corresponding to its logic level. For example, the column electrode drive circuit 55 converts the pixel drive data bit of a logic level of 0 to the pixel data pulse DP of a positive high voltage, while converts the pixel drive data bit of a logic level of 1 to the pixel data pulse DP of a low voltage (0 volt). Then, it applies the pixel data pulse DP to the column electrodes $D_1$ to $D_m$ for each display line in synchronization with the application timing of a scanning pulse SP. More specifically, the column electrode drive circuit 55 first applies the pixel data pulse group DP1 formed of m pulses of the pixel data pulses DP corresponding to the first display line to the column electrodes $D_1$ to $D_m$, and then applies the pixel data pulse group DP2 formed of m pulses of the pixel data pulses DP corresponding to the second display line to the column electrodes $D_1$ to $D_m$. Between the column electrode D and the row electrode Y in the display cell PC to which the scanning pulse SP of the negative voltage and the pixel data pulse DP of the high voltage have been simultaneously applied, selective erasure discharge is generated to eliminate wall electric charge formed in the display cell PC. On the other hand, in the display cell PC to which the scanning pulse SP has been applied as well as the pixel data pulse DP of the low voltage (0 Volt), the selective erasure discharge as above is not generated. Therefore, the state to form wall electric charge is maintained in the display cell PC. More specifically, wall electric charge remains as it is when it exists in the display cell PC, whereas the state not to form wall electric charge is maintained when wall electric charge does not exist.

In this manner, in the address stage W based on the selective erasure addressing method, selective erasure addressing discharge is selectively generated in each of the display cells PC in accordance with each data bit in the pixel drive data bit group corresponding to the subfield, and then wall electric charge is removed. Thus, the display cell PC in which wall electric charge remains is set in the lighting state, and the display cell PC in which wall electric charge is removed is set in the unlighted state.

Subsequently, in the sustain stage I in each of the subfields, the X-row electrode drive circuit 51 and the Y-row electrode drive circuit 53 alternately, repeatedly apply positive sustain pulses $IP_X$ and $IP_Y$ to the row electrodes $X_1$ to $X_n$ and $Y_1$ to $Y_n$. The number of times to apply the sustain pulses $IP_X$ and $IP_Y$ depends on weighting brightness in each of the subfields. At each time that the sustain pulses $IP_X$ and $IP_Y$ are applied, only the display cells PC in the lighting state do sustain discharge, the cells in which a predetermined amount of wall electric charge is formed, and the fluorescent material layer 17 emits light in association with this discharge to form an image on the panel surface.

Figure 11:
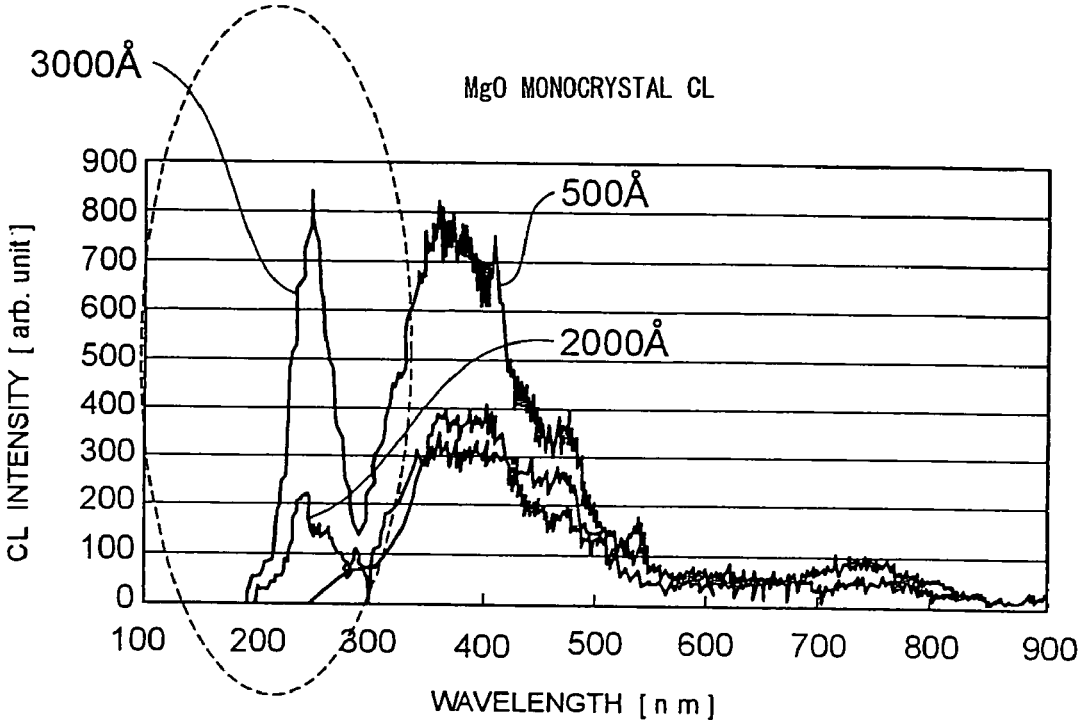
FIG. 11 is a graph illustrating the relationship between the particle diameter of magnesium oxide monocrystal powder and the wavelength of CL light emission.
Figure 12:
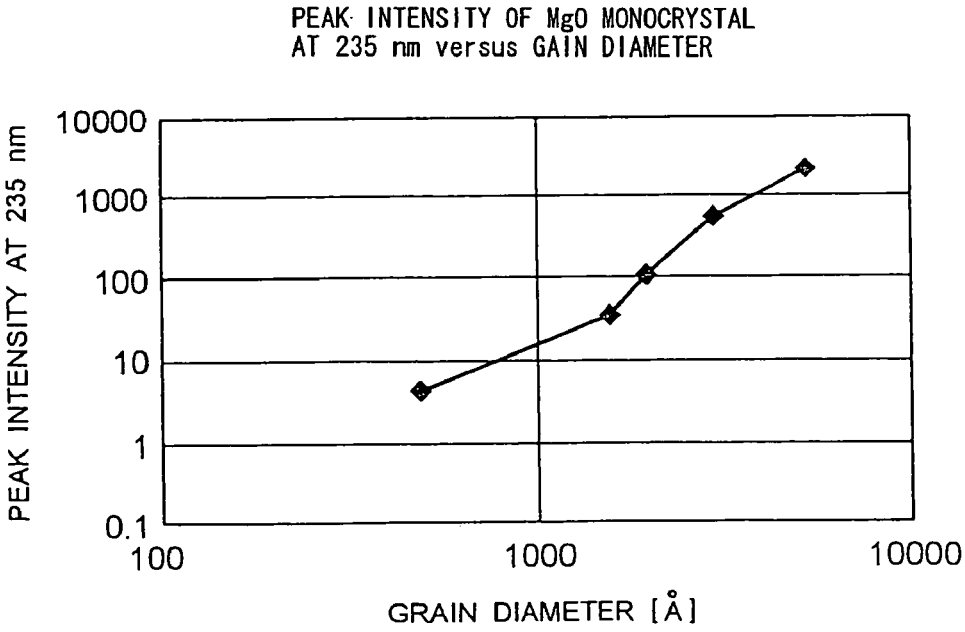
FIG. 12 is a graph illustrating the relationship between the particle diameter of magnesium oxide monocrystal powder and the intensity of CL light emission at 235 nm.

As described above, the vapor phase magnesium monocrystals contained in the magnesium oxide layer 13 formed in each of the display cells PC are excited by irradiating electron beams to do CL light emission having a peak within a wavelength range of 200 to 300 nm (particularly, near 235 nm within 230 to 250 nm) as shown in FIG. 11. As shown in FIG. 12, the greater the particle diameter of each of the vapor phase magnesium oxide crystals is, the greater the peak intensity of CL light emission is. More specifically, when magnesium is heated at temperature higher than usual in generating the vapor phase magnesium oxide crystals, vapor phase magnesium oxide monocrystals having the average particle diameter of 500 angstrom are formed as well as relatively large monocrystals having the particle diameter of 2000 angstrom or greater as shown in FIG. 5 or FIG. 6. Since temperature to heat magnesium is higher than usual, the length of flame generated by reacting magnesium with oxygen also becomes longer. Thus, the difference between a temperature of the flame and an ambient temperature becomes great, and therefore a group of vapor phase magnesium oxide monocrystals having a greater particle diameter particularly contain many monocrystals of high energy level corresponding to 200 to 300 nm (particularly near 235 nm).

Figure 13:
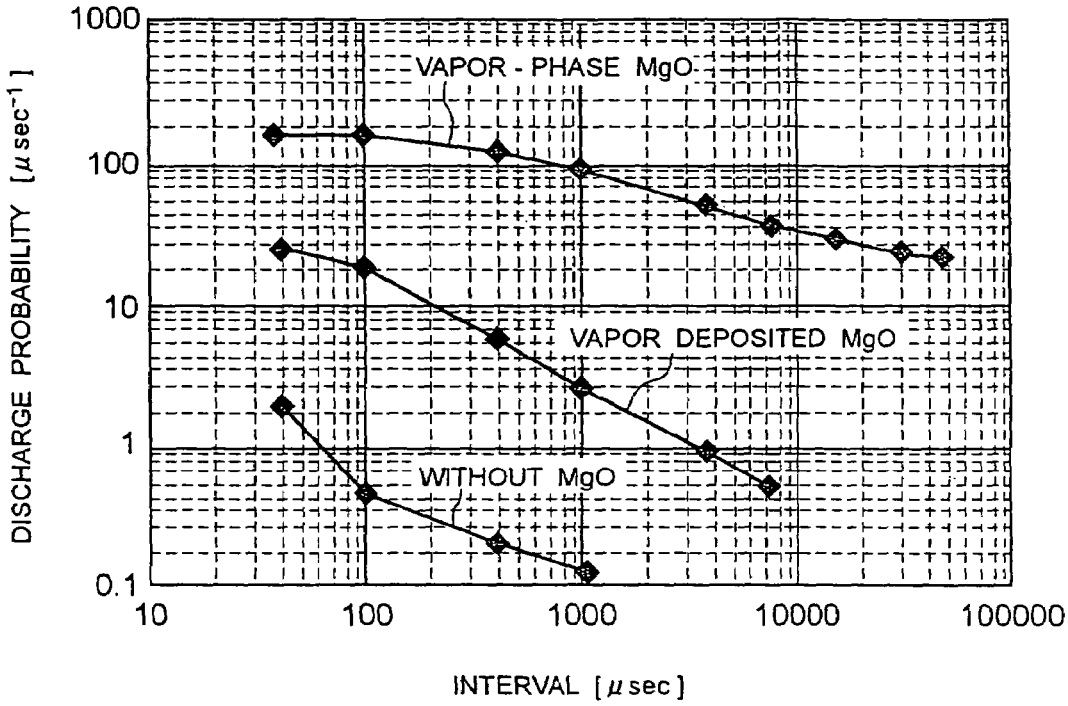
FIG. 13 is a diagram illustrating a discharge probability when no magnesium oxide layer is constructed in a display cell, a discharge probability when a magnesium oxide layer is constructed by traditional vapor deposition, and a discharge probability when a magnesium oxide layer of a polycrystal structure is constructed.

FIG. 13 is a diagram illustrating discharge probabilities: the discharge probability when no magnesium oxide layer was provided in the display cell PC; the discharge probability when the magnesium oxide layer is constructed by traditional vapor deposition; and the discharge probability when the magnesium oxide layer was provided which contained vapor phase magnesium oxide monocrystals to generate CL light emission having a peak at 200 to 300 nm (particularly near 235 nm within 230 to 250 nm) by irradiating electron beams. In addition, in FIG. 13, the horizontal axis is dwell time of discharge, that is, a time interval from discharge being generated to next discharge being generated.

Figure 14:
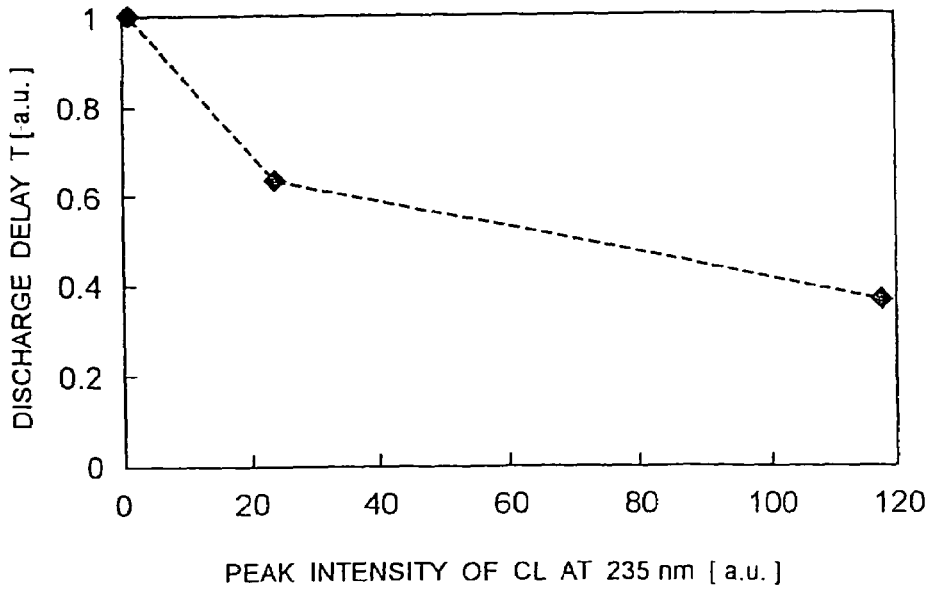
FIG. 14 is a diagram illustrating the correspondence between CL light emission intensity at a 235-nm peak and discharge delay time.

In this manner, when the magnesium oxide layer 13 is formed which contains the vapor phase magnesium oxide monocrystals that do CL light emission having a peak at 200 to 300 nm (particularly near 235 nm within 230 to 250 nm) by irradiating electron beams as shown in FIG. 5 or FIG. 6 in the discharge space S in each of the display cells PC, the discharge probability is higher than the case where the magnesium oxide layer is formed by traditional vapor deposition. In addition, as shown in FIG. 14, for the vapor phase magnesium oxide monocrystals described above, those of greater CL light emission intensity having a peak particularly at 235 nm in irradiating electron beams can shorten discharge delay generated in the discharge space S.

Therefore, even though voltage transition of the reset pulse to be applied to the row electrode is made smooth to weaken reset discharge as shown in FIG. 10 in order to suppress light emission in association with reset discharge that relates to no display image and to improve contrast, this weak reset discharge can be stabilized for a short time to be generated. Particularly, since each of the display cells PC adopts the structure in which local discharge is generated near the discharge gap between the T-shaped transparent electrodes Xa and Ya, a strong, sudden reset discharge that might be discharged in all the row electrodes can be suppressed as well as error discharge between the column electrode and the row electrode can be suppressed.

Furthermore, since the increased discharge probability (shortened discharge delay) allows a long, continuous priming effect by reset discharge in the reset stage R, address discharge generated in the address stage W and sustain discharge generated in the sustain stage I are high speed. Therefore, the pulse widths of the pixel data pulse DP and the scanning pulse SP to be applied to the column electrode D and the row electrode Y in order to generate address discharge as shown in FIG. 10 can be shortened. By that amount, processing time for the address stage W can be shortened. Moreover, the pulse width of the sustain pulse $IP_Y$ to be applied to the tow electrode Y in order to generate sustain discharge as shown in FIG. 10 can be shortened. By that amount, processing time for the sustain stage I can be shortened.

Accordingly, by the amount of the shortened processing time for each of the address stage W and the sustain stage I, the number of subfields to be provided in one field (or one frame) display period can be increased, and the number of gray scales can be intended to increase.

Figure 15:
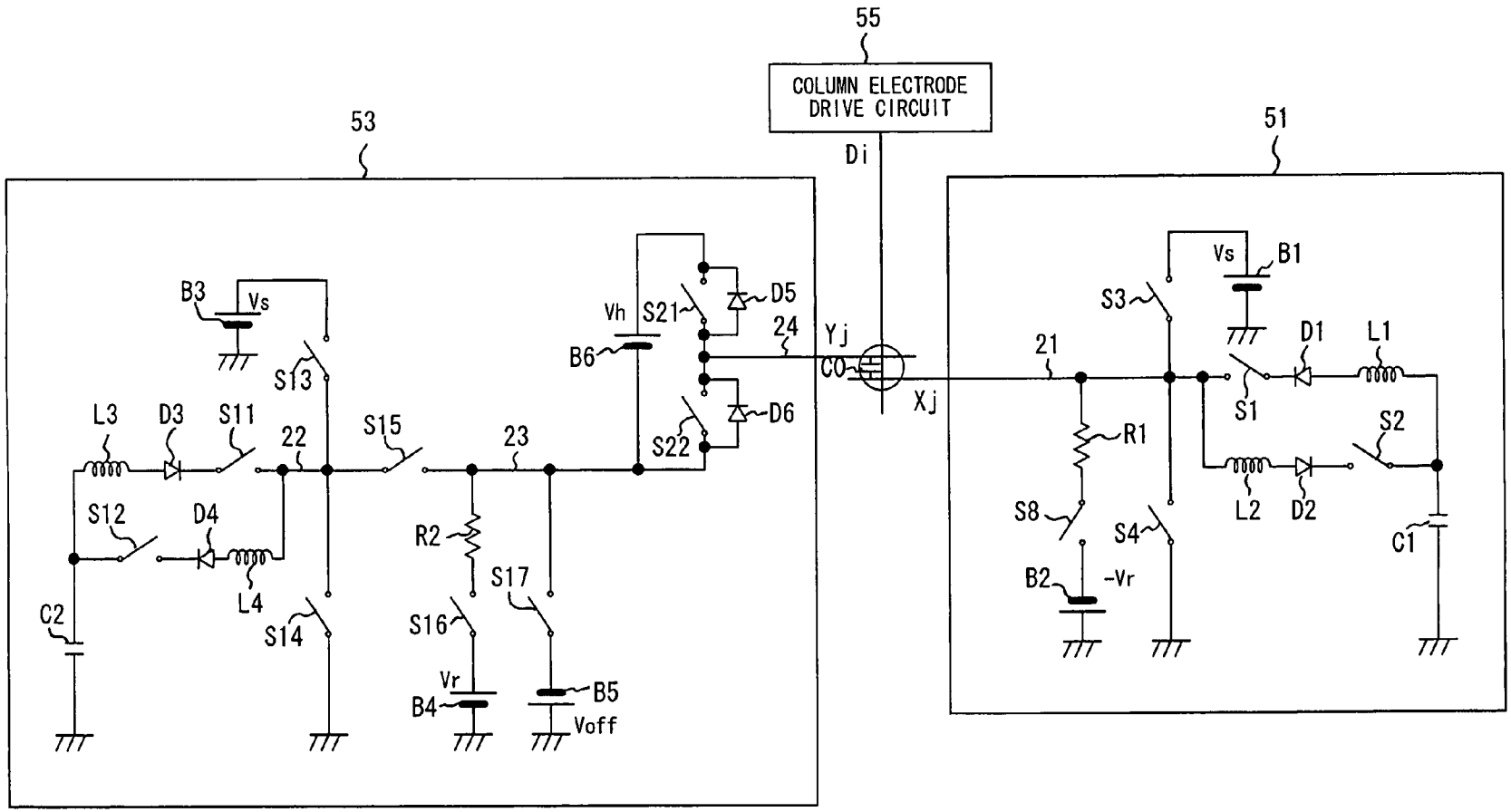
FIG. 15 is a circuit diagram illustrating a specific configuration of an X-row electrode drive circuit and a Y-row electrode drive circuit in the device shown in FIG. 1.

FIG. 15 depicts a specific configuration of the X-row electrode drive circuit 51 and the Y-row electrode drive circuit 53 on electrodes $X_j$ and $Y_j$. The electrode $X_j$ is the electrode at the jth line in electrodes $X_1$ to $X_n$, and the electrode $Y_j$ is the electrode at the jth line in the electrodes $Y_1$ to $Y_n$. The portion between the electrodes $X_j$ and $Y_j$ serves as a condenser CO.

In the X-row drive circuit 51, two power sources B1 and B2 are provided. The power source B1 outputs a voltage $V_s$ (for example, 170 V), and the power source B2 outputs a voltage $V_r$ (for example, 190 V). A positive terminal of the power source B1 is connected to a connection line 21 for the electrode $X_j$ through a switching element S3, and a negative terminal thereof is grounded. Between the connection line 21 and the ground, a switching element S4 is connected, as well as a series circuit formed of a switching element S1, a diode D1 and a coil L1, and a series circuit formed of a coil L2, a diode D2 and a switching element S2 are connected to the ground side commonly through a condenser C1. In addition, the diode D1 has an anode on the condenser C1 side, and the diode D2 is connected as the condenser C1 side is a cathode. Furthermore, a positive terminal of the power source B2 is connected to the connection line 21 through a switching element S8 and a resistor R1, and a negative terminal of the power source B2 is grounded.

In the Y-row electrode drive circuit 53, four power sources B3 to B6 are provided. The power source B3 outputs a voltage $V_s$ (for example, 170 V), the power source B4 outputs a voltage $V_r$ (for example, 190 V), the power source B5 outputs a voltage $V_{off}$ (for example, 140 V), and the power source B6 outputs a voltage $V_h$ (for example, 160 V, $V_h > V_{off}$). A positive terminal of the power source B3 is connected to a connection line 22 for a switching element S15 through a switching element S13, and a negative terminal thereof is grounded. Between the connection line 22 and the ground, a switching element S14 is connected as well as a series circuit formed of a switching element S11, a diode D3 and a coil L3, and a series circuit formed of a coil L4, a diode D4 and a switching element S12 are connected to the ground side commonly through a condenser C2. In addition, the diode D3 has an anode on the condenser C2 side, and the diode D4 is connected as the condenser C2 side is a cathode.

The connection line 22 is connected to a connection line 23 for the negative terminal of the power source B6 through the switching element S15. Positive terminals of the power sources B4 and B5 are grounded, and negative terminals thereof are connected to the connection line 23 through a switching element S16 and a resistor R2. The negative terminal of the power source B5 is connected to the connection line 23 through a switching element S17.

The positive terminal of the power source B6 is connected to a connection line 24 for the electrode $Y_j$ through a switching element S21, and the negative terminal of the power source B6 connected to the connection line 23 is connected to the connection line 24 through a switching element S22. The diode D5 is connected in parallel to the switching element S21, and the diode D6 is connected in parallel to the switching element S22. The diode D5 has an anode on the connection line 24 side, and the diode D6 is connected as the connection line 24 side is a cathode.

The drive control circuit 56 controls turning on and off the switching elements S1 to S4, S8, S11 to S17, S21 and S22.

In addition, in the X-row electrode drive circuit 51, the power source B3, the switching elements S11 to S15, the coils L3 and L4, the diodes D3 and D4, and the condenser C2 configure a sustain driver part, the power source B4, the resistor R2, and the switching element S16 configure a reset driver part, and the remaining power sources B5 and B6, the switching elements S13, S17, S21, S22, and the diodes D5 and D6 configure a scan driver part.

Next, the operations of the X-row electrode drive circuit 51 and the Y-row electrode drive circuit 53 in this configuration will be described with reference to a time chart shown in FIG. 16.

First, in the reset stage, the switching element S8 of the X-row electrode drive circuit 51 is turned on, and the switching elements S16 and S22 of the Y-row electrode drive circuit 53 are both turned on. The other switching elements are off. Turning on the switching elements S16 and S22 carries current from the positive terminal of the power source B4 to the electrode $Y_j$ through the switching element S16, the resistor R2 and the switching element S22, and turning on the switching element S8 carries current from the electrode $X_j$ through the resistor R1, and the switching element S8 to the negative terminal of the power source B2. The potential of the electrode $X_j$ is gradually decreased by the time constant of the condenser CO and the resistor R1, and is the reset pulse $PR_X$, whereas the potential of the electrode $Y_j$ is gradually increased by the time constant of the condenser CO and the resistor R2, and is the reset pulse $PR_Y$. The reset pulse $PR_X$ finally becomes a voltage $-V_r$, and the reset pulse $PR_Y$ finally becomes a voltage $V_r$. The reset pulse $PR_X$ is applied to all the electrodes $X_1$ to $X_n$ at the same time, and the reset pulse $PR_Y$ is generated for each of the electrodes $Y_1$ to $Y_n$ and is applied to all the electrodes $Y_1$ to $Y_n$.

The simultaneous application of the reset pulses $RP_X$ and $RP_Y$, all the display cells of the PDP 1 are discharge excited to generate charged particles, and after terminating the discharge, a predetermined amount of wall electric charge is evenly formed on the dielectric layer of all the display cells.

After the levels of the reset pulses $RP_X$ and $RP_Y$ are saturated, the switching elements S8 and S16 are turned off before the reset stage is ended. Furthermore, the switching elements S4, S14 and S15 are turned on at this time, and the electrodes $X_j$ and $Y_j$ are both grounded. Thus, the reset pulses $RP_X$ and $RP_Y$ go out.

Subsequently, when the address stage is started, the switching elements S14, S15 and S22 are turned off, the switching element S17 is turned on, and the switching element S21 is turned on at the same time. Thus, since the power source B6 is serially connected to the power source B5, the potential of the positive terminal of the power source B6 is $V_h$-$V_{off}$. The positive potential is applied to the electrode $Y_j$ through the switching element S21.

In the address stage, the column electrode drive circuit 55 converts pixel data for each pixel based on the video signal to the pixel data pulses $DP_1$ to $DP_n$ having a voltage value corresponding to its logic level, and sequentially applies them to the column electrodes $D_1$ to $D_m$ for each one display line. As shown in FIG. 16, the pixel data pulses $DP_j$, $DP_{j-1}$ with respect to the electrodes $Y_j$, $Y_{j+1}$ are applied to the column electrode $D_i$.

The Y-row electrode drive circuit 53 sequentially applies the scanning pulse SP of the negative voltage to the row electrodes $Y_1$ to $Y_n$ in synchronization with the timing of each of the pixel data pulse groups $DP_1$ to $DP_n$.

In synchronization with the application of the pixel data pulse $DP_j$ from the column electrode drive circuit 55, the switching element S21 is turned off, and the switching element S22 is tuned on. Thus, the negative potential $-V_{off}$ of the negative terminal of the power source B5 is applied to the electrode $Y_j$ as the scanning pulse SP through the switching element S17 and the switching element S22. Then, in synchronization with the stop of the application of the pixel data pulse $DP_j$ from the column electrode drive circuit 55, the switching element S21 is turned on, the switching element S22 is turned off, and the potential $V_h$-$V_{off}$ of the positive terminal of the power source B6 is applied to the electrode $Y_j$ through the switching element S21. After that, as shown in FIG. 16, the scanning pulse SP is applied to the electrode $Y_{j+1}$ as similar to the electrode $Y_j$ in synchronization with the application of the pixel data pulse $DP_{j+1}$ from the column electrode drive circuit 55.

In the display cells belonging to the row electrode to which the scanning pulse SP has been applied, discharge is generated in the display cell to which the pixel data pulse of the positive voltage has been further applied at the same time, and most of its wall electric charge are lost. On the other hand, since discharge is not generated in the display cell to which the scanning pulse SP has been applied but the pixel data pulse of the positive voltage has not been applied, the wall electric charge still remains. The display cell in which the wall electric charge remains is the lighting state, and the display cell in which the wall electric charge has gone out is in the unlighted state.

In switching from the address stage to the sustain stage, the switching elements S17 and S21 are turned off, and the switching elements S14, S15 and S22 are instead turned on. The ON-state of the switching element S4 continues.

In the sustain stage, in the X-row electrode drive circuit 51, turning on the switching element S4 turns the potential of the electrode $X_j$ to nearly 0 V of the ground potential (first potential). Subsequently, when the switching element S4 is turned off and the switching element S1 is turned on, current reaches the electrode $X_j$ through the coil L1, the diode D1, and the switching element S1 by electric charge charged in the condenser C1 to flow into the condenser CO, and then the condenser CO is charged. At this time, the time constant of the coil L1 and the condenser CO gradually increases the potential of the electrode $X_j$ as shown in FIG. 16.

Then, the switching element S3 is turned on. Thus, the potential $V_s$ (second potential) of the positive terminal of the power source B1 is applied to the electrode $X_j$, and the potential of the electrode $X_j$ is clamped to $V_s$.

After that, the switching elements S1 and S3 are turned off, the switching element S2 is turned on, and current is carried from the electrode $X_j$ into the condenser C1 through the coil L2, the diode D2, and the switching element S2 by electric charge charged in the condenser CO. At this time, the time constant of the coil L2 and the condenser C1 gradually decreases the potential of the electrode $X_j$ as shown in FIG. 16. When the potential of the electrode $X_j$ reaches nearly 0V, the switching element S2 is turned off, and the switching element S4 is turned on.

In the X-row electrode drive circuit 51, the period for the first step from when the switching element S1 is turned on to right before the switching element S3 is turned on. The ON-period of the switching element S3 is the period for the second step. The ON-period for the switching element S2 is the period for the third step.

Figure 16:
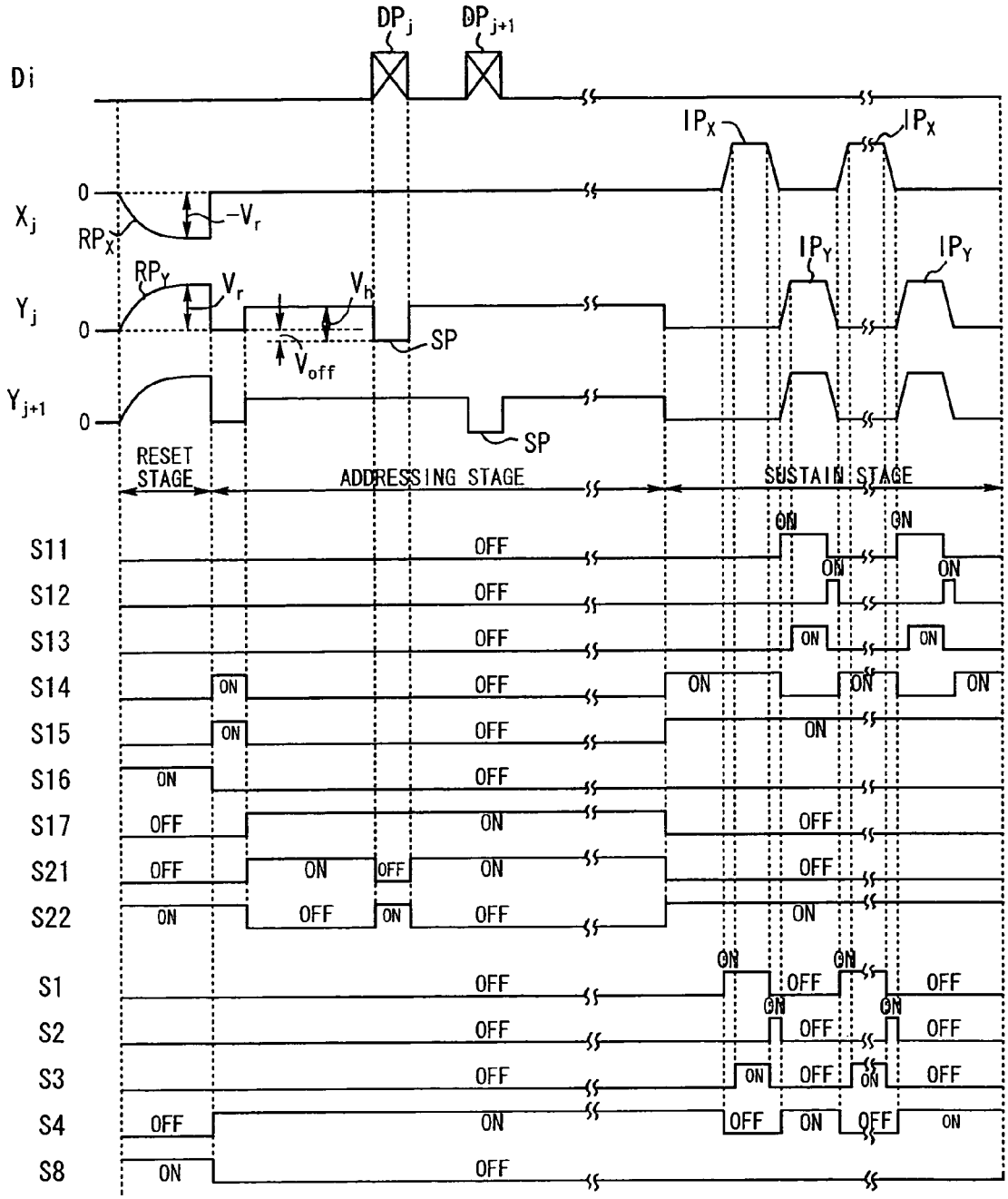
FIG. 16 is a diagram illustrating switching operations and voltage waveforms of each electrode in the drive circuit shown in FIG. 15.

By this operation, the X-row electrode drive circuit 51 applies the sustain pulse $IP_X$ of the positive voltage to the electrode $X_j$ as shown in FIG. 16.

In the Y-row electrode drive circuit 53, at the same time when turning on the switching element S4 where the sustain pulse $IP_X$ goes out, the switching element S11 is turned on, and the switching element S14 is turned off. The potential of the electrode $Y_j$ is the ground potential of nearly 0 V when the switching element S14 is on. However, when the switching element S14 is turned off and the switching element S11 is turned on, current reaches the electrode $Y_j$ through the coil L3, the diode D3, the switching element S11, the switching element S15, and the diode D6 by electric charge charged in the condenser C2 to flow into the condenser CO, and then the condenser CO is charged. At this time, the time constant of the coil L3 and the condenser CO gradually increases the potential of the electrode $Y_j$ as shown in FIG. 16.

Subsequently, the switching element S13 is turned on. Thus, the potential $V_s$ of the positive terminal of the power source B3 is applied to the electrode $Y_j$ through the switching element S13, the switching element S15, and the diode D6.

After that, the switching elements S11 and S13 are turned off, the switching element S12 is turned on, the switching element S22 is turned on, and current flows from the electrode $Y_j$ into the condenser C2 through the switching element S22, the switching element S15, the coil L4, the diode D4, and the switching element S12 by electric charge charged in the condenser CO. At this time, the time constant of the coil L4 and the condenser C2 gradually decreases the potential of the electrode $Y_j$ as shown in FIG. 16. When the potential of the electrode $Y_j$ reaches nearly 0 V, the switching elements S12 and S22 are turned off, and the switching element S14 is turned on.

Also in the Y-row electrode drive circuit 53, it is the period for the first step from when turning on the switching element S11 to right before turning on the switching element S13. The ON-period of the switching element S13 is the period for the second step. The ON-period of the switching element S12 is the period for third step.

By this operation, the Y-row electrode drive circuit 53 applies the sustain pulse $IP_Y$ of the positive voltage to the electrode $Y_j$ as shown in FIG. 16.

In this manner, in the sustain stage, since the sustain pulse $IP_X$ and the sustain pulse $IP_Y$ are alternately generated and alternately applied to the electrodes $X_1$ to $X_n$ and the electrodes $Y_1$ to $Y_n$, the display cell in which the wall electric charge still remains repeats discharge light emission to maintain its lighting state.

Figure 17A:
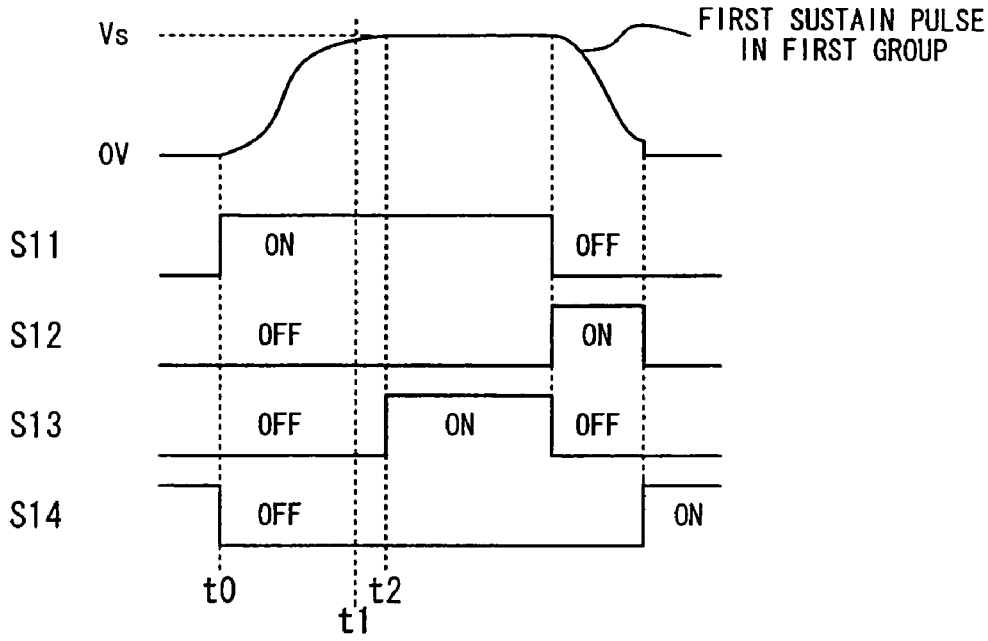
FIGS. 17A and 17B are diagrams illustrating specific waveforms and switching operations of sustain pulses in first and second groups.
Figure 17B:
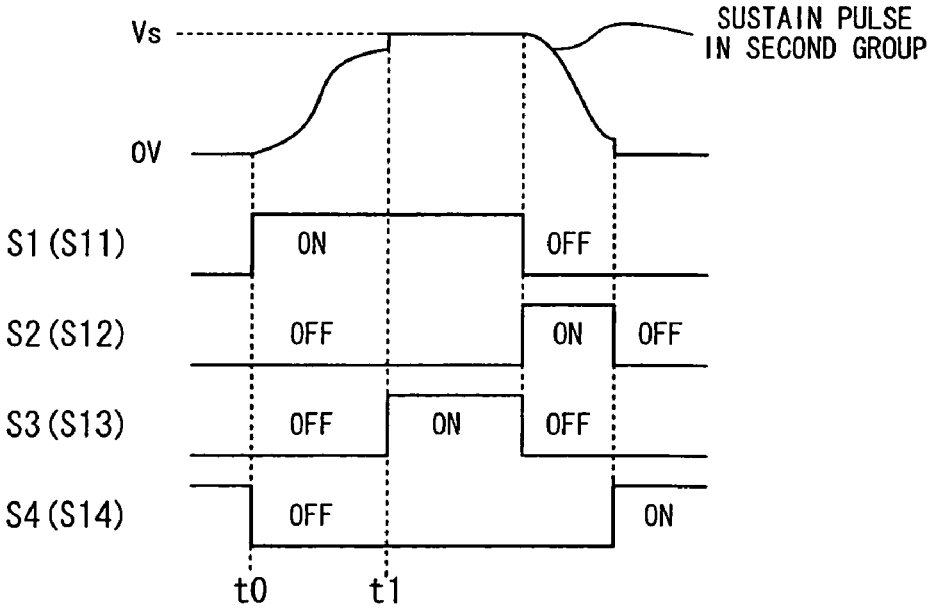

In the sustain stage, the timing to clamp the potential of the sustain pulse $IP_X$ ($IP_Y$) to $V_s$ is different between the first group including the beginning first sustain pulse of each of the subfields and the second group after that. In the X-row electrode drive circuit 51, when it is explained that suppose the switching element S1 is turned on and the switching element S4 is turned off at a time point t0 in both the first and second groups, in the first group, as shown in FIG. 17A, the switching element S3 is turned on at a time point t2, but in the second group, as shown in FIG. 17B, the switching element S3 is turned on at a time point t1 earlier than the time point t2. Therefore, the sustain pulse $IP_X$ in the second group is clamped to the potential $V_s$ at the time point t1. More specifically, the sustain pulse $IP_X$ in the second group is clamped to the potential $V_s$ by resonance effect before it reaches the potential $V_s$. On the other hand, the sustain pulse $IP_X$ in the first group is clamped to the potential $V_s$ at the time point t2 delayed from the time point t1. The time point t2 is a time after reached to the potential $V_s$ of the sustain pulse $IP_X$ by resonance effect.

If the second sustain pulse as well as the first sustain pulse belong to the first group, the second sustain pulse may be generated at a time point for clamping to the potential $V_s$ as the first sustain pulse shown in FIG. 17A. Furthermore, the sustain pulse $IP_Y$ in the Y-row electrode drive circuit 53 is the same, not limited to the X-row electrode drive circuit 51. In this case, the following may be configured: a rise period of the first sustain pulse in the first group (resonance transition period; t0 to t2)>a rise period of the second sustain pulse in the first group (resonance transition period; t0 to t2=)>a rise period of the sustain pulse in the second group (resonance transition period; t0 to t1). Moreover, in the subfield where only two sustain pulses exist to be applied to the sustain period, the rise periods of the firsthand second sustain pulses are made longer than the rise period of the sustain pulse in the second group in the sustain period of the subfield where three or more of sustain pulses exist to be applied to the sustain period (resonance transition period; t0 to t1). Namely a time point to be clamped to the second potential is delayed. Besides, it may be configured in which the rise period of the sustain pulse in the first group in the subfield where the number of the sustain pulses to be assigned is small among multiple subfields (a time point to be clamped to the second potential) is made longer (delayed) than the rise period of the sustain pulse in the first group in the subfield where the number of the sustain pulses to be assigned is great (a time point to be clamped to the second potential).

When the sustain pulse is clamped to $V_s$ before the resonance potential reaches $V_s$, a discharge start voltage is increased, so that brightness can be increased. However, in the panel with improved discharge probability, discharge is generated simultaneously in many display cells, and a large current is momentarily carried to distort the voltage waveform. Consequently, when discharge is slightly delayed or accelerated, voltage values applied in discharge are varied, and discharge intensity for each cell is changed to cause brightness variations to impair display quality. Then, in the first sustain pulse where an amount of priming particles is small and discharge tends to be varied, the time point to be clamped to $V_s$ is delayed, that is, the electrode potential is clamped to $V_s$ after it reaches $V_s$, and thus ringing of the Voltage waveform can be suppressed, and instability of discharge can be suppressed.

In addition, for the PDP 50 in the embodiment, the structure is adopted in which the display cell PC is formed between the row electrodes X and the row electrodes Y that are paired with each other as $(X_1, Y_1)$, $(X_2, Y_2)$, $(X_3, Y_3)$, Ψ, $(X_n, Y_n)$. However, the structure may be adopted in which the display cell PC is formed between all the row electrodes. More specifically, the structure may be adopted in which the display cell PC is formed between the row electrodes $X_1$ and $Y_1$, the row electrode $Y_1$ and $X_2$, the row electrode $X_2$ and $Y_2$, Ψ, the row electrode $Y_{n-1}$ and $X_n$, the row electrode $X_n$ and $Y_n$.

Furthermore, for the PDP 50 in the embodiment, the structure is adopted in which the row electrodes X and Y are formed in the front transparent substrate 10 and the column electrode D and the fluorescent material layer 17 are formed in the rear substrate 14. However, the structure may be adopted in which the column electrodes D as well as the row electrodes X and Y are formed in the front transparent substrate 10 and the fluorescent material layer 17 is formed in the rear substrate 14.

As described above, according to the invention, in the sustain period, even though many display cells are set in the lighting state, variation in discharge intensity in each of the display cells can be prevented to improve display quality.

This application is based on Japanese Patent Application No. 2004-338724 which is hereby incorporated by reference.

What is claimed is:

1. A plasma display device for displaying an image on a plasma display panel in accordance with an input video signal, said plasma display panel having a plurality of row electrode pairs, a plurality of column electrodes intersecting with said plurality of row electrode pairs and forming display cells at the intersections, respectively, and a display period for one field of the input video signal is configured of a plurality of subfields each formed of an address period and a sustain period for the image display, said plasma display device comprising:

a magnesium oxide layer formed at a portion facing said discharge space in each of said display cells, having magnesium oxide monocrystals which are excited by irradiating an electron beam to emit cathode luminescence light having a peak within a wavelength range of 200 to 300 nm, and which have a particle diameter of 2000 angstroms or greater;

an address portion which selectively generates address discharge in each of said display cells in accordance with pixel data based on the video signal in the address period;

a sustain portion which applies a sustain pulse between row electrodes forming each of said row electrode pairs in said sustain period; and a reset portion which applies a reset pulse between the row electrodes forming said row electrode pair before the address period for at least one subfield in one field of a display period in order to generate reset discharge in all of said display cells, wherein said sustain portion includes:

a first transition portion which makes resonance transition of a potential of a row electrode of each of said row electrode pairs from a first potential to a second potential;

a clamp portion which clamps the potential of said row electrode to said second potential; and a second transition portion which makes resonance transition of the potential of said row electrode from said second potential to said first potential, and wherein a first step of making transition from said first potential to said second potential, a second step of clamping to said second potential, and a third step of making transition from said second potential to said first potential are sequentially implemented in order to generate said sustain pulse, and in said sustain period for each of the subfields, a time point to clamp to said second potential at least one sustain pulse belonging to a first group including a sustain pulse to be first applied is delayed comparing to a time point to clamp to said second potential a sustain pulse belonging to other groups.

2. The plasma display device according to claim 1, wherein said sustain portion moves to the second step before the potential of the row electrode reaches the second potential at said first step when generating the sustain pulse belonging to said first group, and moves to the second step after the potential of the row electrode reaches the second potential at said first step when generating the sustain pulse belonging to said other groups.

3. The plasma display device according to claim 1, wherein said magnesium oxide monocrystals are generated by vapor phase oxidation of magnesium steam that is generated by heating magnesium.

4. The plasma display device according to claim 1, wherein said magnesium oxide monocrystals emit cathode luminescence light having a peak within a wavelength range of 230 to 250 nm.

5. The plasma display device according to claim 1, wherein said magnesium oxide layer is formed on a dielectric layer which covers each of said row electrode pairs.

6. The plasma display device according to claim 1, wherein said reset portion generates reset discharge only in the address period for a starting subfield in one field; and said address portion implements selective discharge only in the address period for one of the subfields in one field with respect to each of the display cells.

* * * * *